United States Patent [19]

Labrue

[11] 4,100,750

[45] Jul. 18, 1978

[54] METHOD FOR THE PRODUCTION OF PILES CAST IN THE GROUND AND HOLLOW AUGER FOR IMPLEMENTING THE METHOD

[76] Inventor: Jean-Marie Labrue, 31, rue Gustave-Gaillard, 33 Saint-Medard-en-Jalles, France

[21] Appl. No.: 704,403

[22] Filed: Jul. 12, 1976

[30] Foreign Application Priority Data

Jul. 17, 1975 [FR] France ..... 75 22328

[51] Int. Cl.[2] ..... E02D 5/34

[52] U.S. Cl. ..... 61/53.64; 175/22; 175/257; 175/394

[58] Field of Search ..... 61/53.64, 53.66, 56, 61/56.5, 53.6, 53.52; 175/394, 22, 257

[56] References Cited

U.S. PATENT DOCUMENTS 3,228,200 1/1966 Dufresne ..... 61/53.64

3,391,544 7/1968 Daczko ..... 61/53.64

3,805,535 4/1974 VanWeele ..... 61/53.52

*Primary Examiner*—Jacob Shapiro

[57] ABSTRACT

The invention relates to a hollow auger and to a method for producing piles cast in the ground. The method is characterized in that one uses an auger provided with a removable cutting head and which is able to slide in a sealed manner in the blade support tube of the auger and in that the injection of concrete, taking place through a central passageway provided in the cutting head, is undertaken in two successive stages, a first stage in which concrete is injected into the support tube by progressively raising the cutting head to a predetermined level, namely zero level in the latter and a second stage in which the auger is raised from the drill-hole by exerting a constant pressure on the cutting head and by injecting concrete in order to maintain this head at the predetermined level. The invention has application in the manufacture of piles cast from concrete.

3 Claims, 7 Drawing Figures

Figure 1:
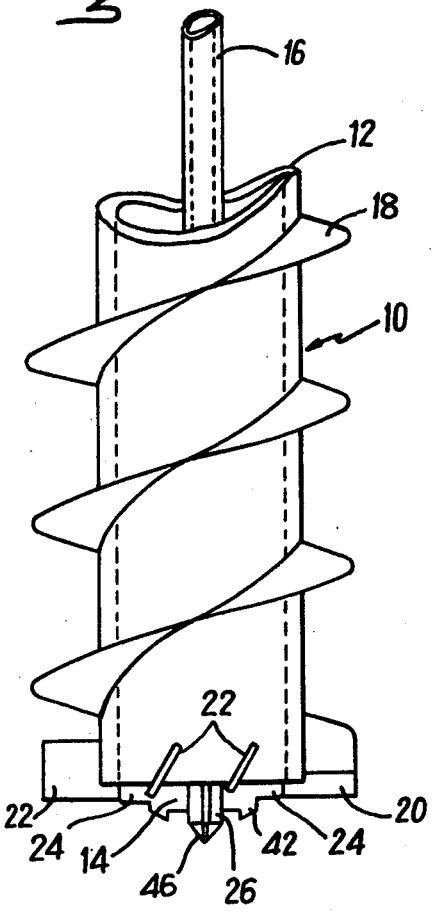

METHOD FOR THE PRODUCTION OF PILES CAST IN THE GROUND AND HOLLOW AUGER FOR IMPLEMENTING THE METHOD

The present invention relates to methods for the production of piles cast in the ground by the injection of concrete.

Amongst the various techniques currently used for producing concrete piles cast in the ground, a method has already been proposed, according to which a hole is drilled in the ground by means of a hollow auger and the auger is then raised progressively out of the drill-hole whilst simultaneously injecting concrete under pressure into the hole thus obtained.

Hollow augers generally used in this type of method are constituted by a central tube having an outer diameter of approximately 100 mm and by at least one blade which winds around the tube in the form of a helix. The useful diameter of the auger as well as its length are chosen depending on the rated loads and ground encountered. The range of current auger diameters extends from 400 to 800mm, the length being most frequently 18 meters.

With such an auger, the injection of concrete through the central tube should be sufficient to compensate for the volume liberated by the upwards movement of the auger. In view of the high ratio between the useful diameter of the auger and the diameter of the central tube for supplying concrete (a ratio which is between 4 and 8 and which is translated by a surface ratio of between 16 and 64), it has been found that in certain cases casting of the pile was irregular. Thus, if the auger is raised too quickly or too suddenly, this may result in a constriction in the pile. The injection of concrete, which takes place most frequently at a constant pressure in the region of the filling head, is insufficient to fill the space liberated by the auger.

The object of the invention is to propose an auger and a method making it possible to eliminate this drawback, even in the case where the auger is raised too quickly.

To resolve this problem, the method of the invention is characterised in that an auger is used which is provided with a removable cutting head and is able to slide in a sealed manner in the blade support tube of the auger and in that the injection of concrete, taking place through a central passageway provided in the cutting head, is carried out in two successive stages, a first stage in which concrete is injected into the support tube by progressively raising the cutting head to a predetermined level, or zero level, in the latter and a second stage in which the auger is raised from the drill-hole by exerting constant pressure on the cutting head and by injecting concrete in order to maintain this head at the predetermined level.

The division of the operation for casting the pile into two successive stages (first the stage of filling the support tube and then the stage of filling the hole) and the use of the inner volume of the part of the auger located below the reference level chosen for the head as a "accumulator" for concrete, make it possible to ensure appropriate casting of the pile whatever the inner diameter of the hole and/or the shape of its walls on the one hand and the variation of the extraction speed of the auger, on the other hand.

The invention also relates to a hollow auger facilitating implementation of the above-defined method. An auger of this type is characterised in that it comprises:

- a support tube which is equipped with at least one blade wound in the form of a helix on its outer surface and terminating at the lower end of the support tube in a cutting tooth,
- a removable cutting head provided with cutting teeth and mounted to be able to slide in a sealed manner in the support tube and
- a central tube at the end of which the cutting head is fixed, for the purpose of driving the latter and supplying the central passage with which it is provided, with concrete or similar fluid under pressure.

The fact that the cutting head is removable allows independent control of the cutting head, which may thus move forwards or back with respect to the support tube of the auger, in particular for working in a protruding position in hard ground. It also allows the drilling tool to be changed, whilst the support tube of the auger remains in position, as well as the use of a cutting head in the shape of an auger (such as that described in French Pat. No. 1,591,323 in the name of the Applicant) or even of a drill-core.

According to a preferred arrangement, the ratio between the useful diameter of the auger and the outer diameter of the support tube is between 1 and 2 and preferably 1.3.

Figure 2:
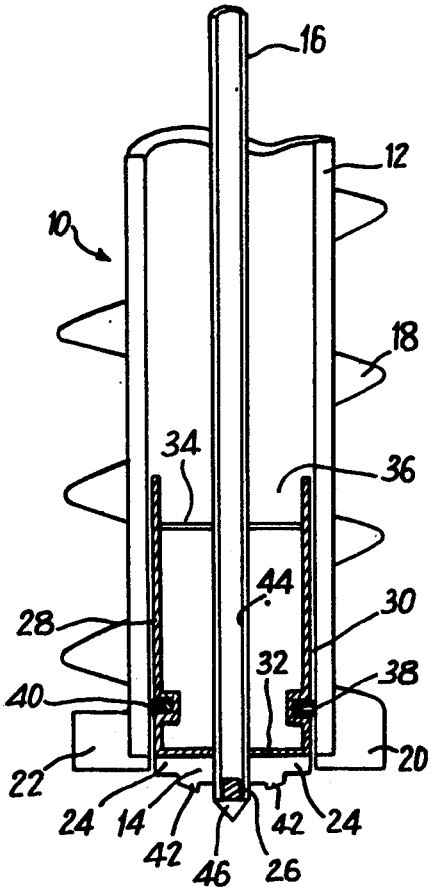
Figure 3:
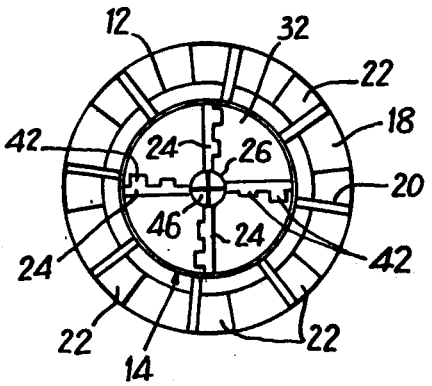
Figure 4:
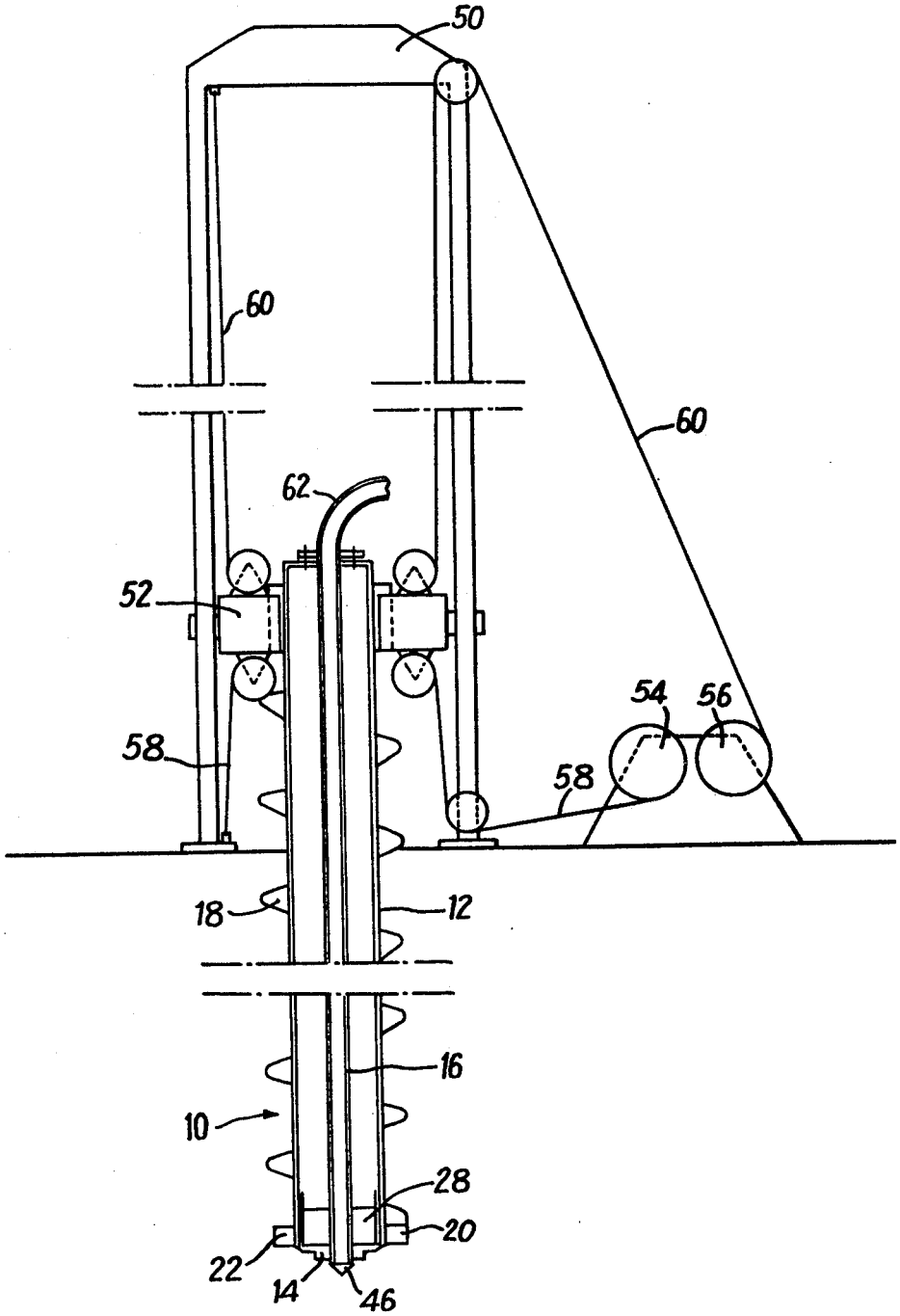
Figure 5:
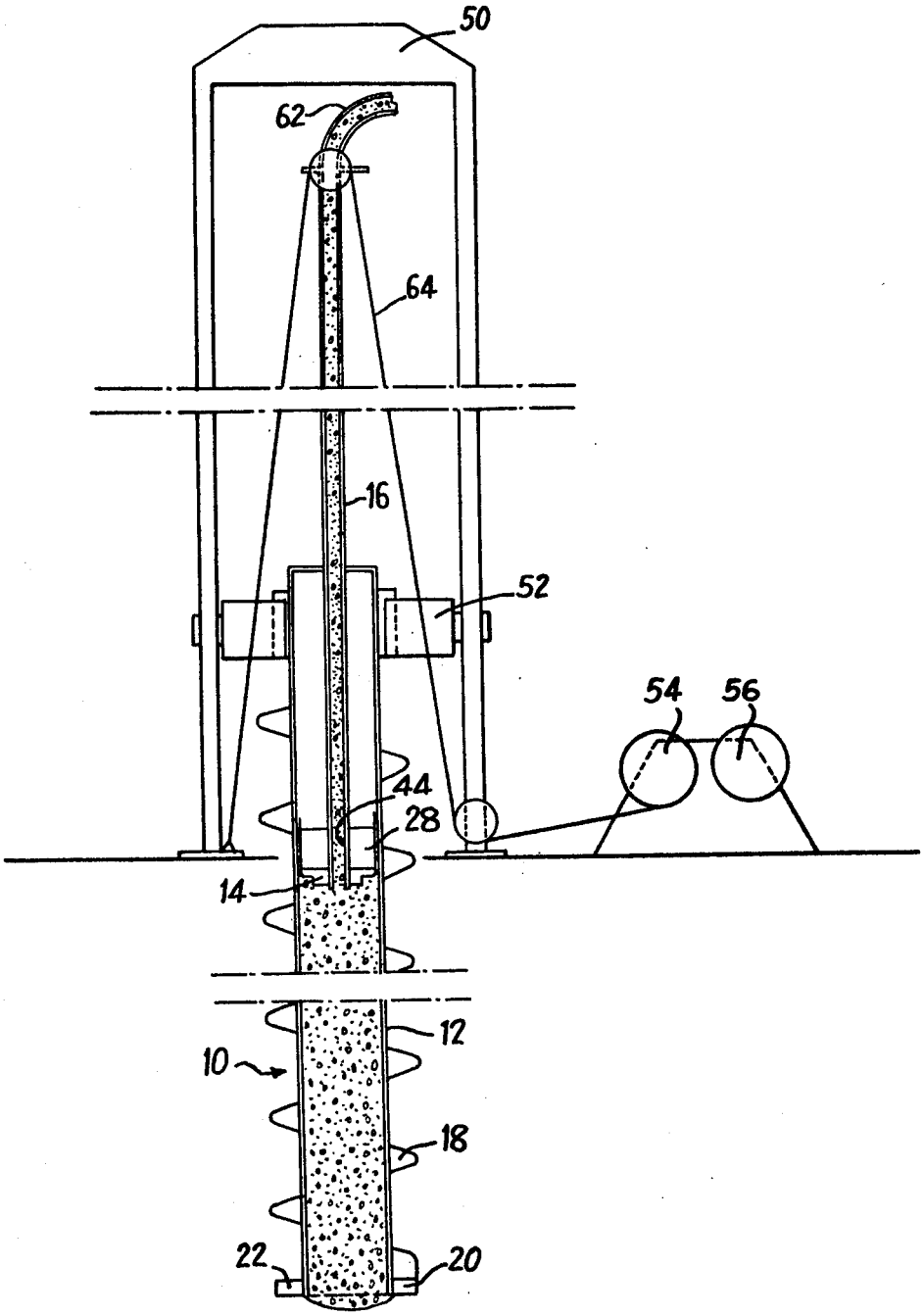
Figure 6:
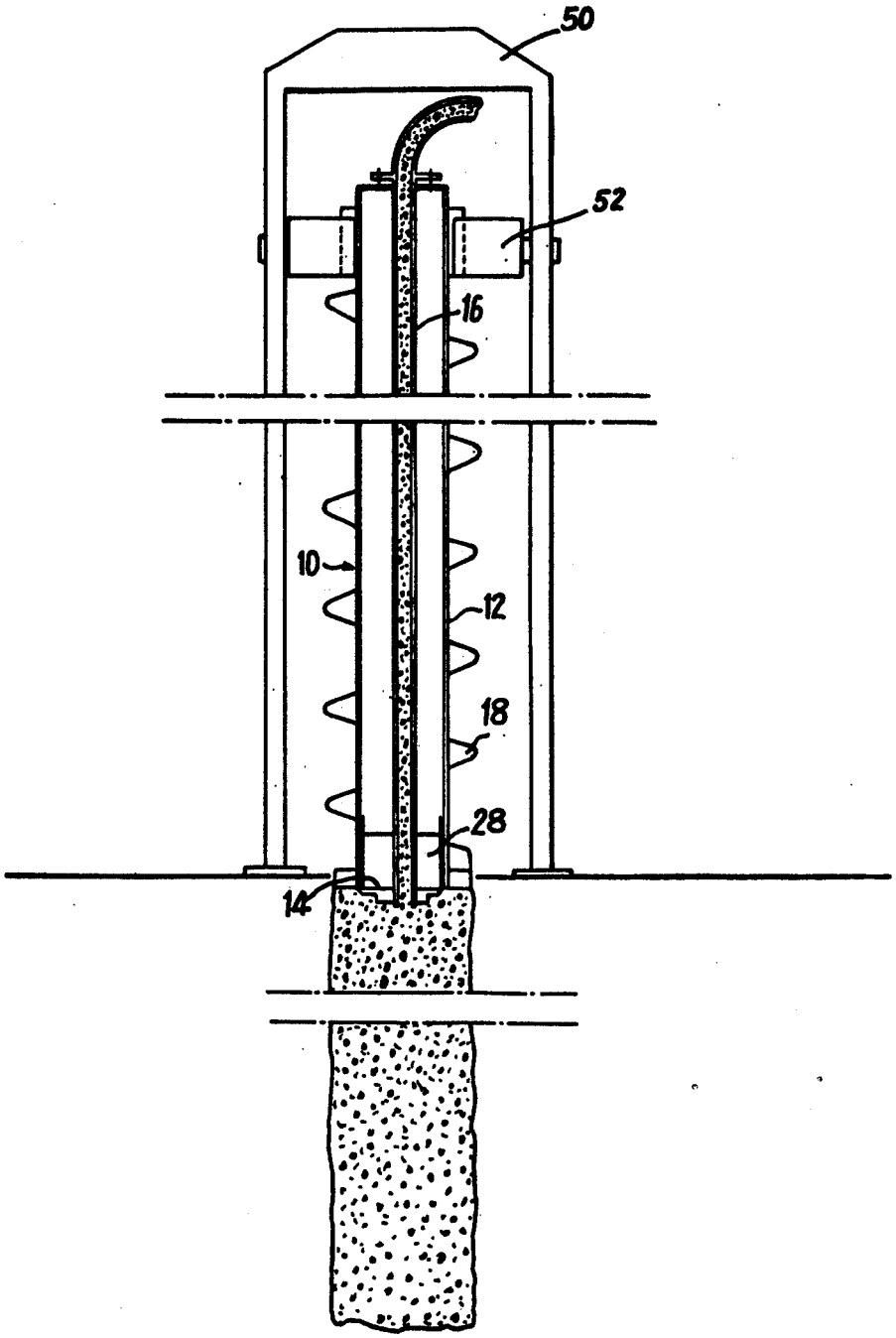
Figure 7:
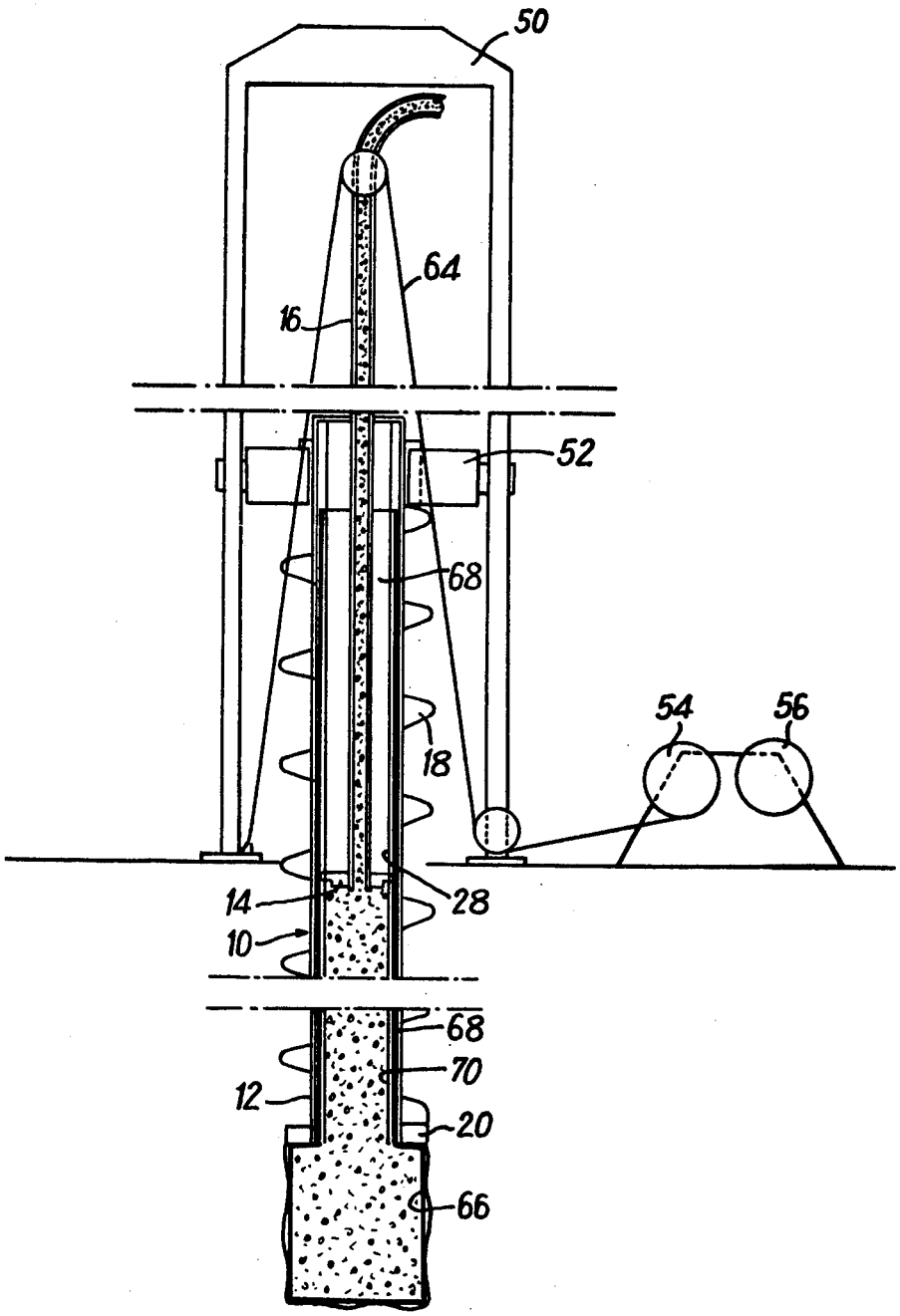

The invention will be better understood on reading the ensuing description which refers to the accompanying drawings given solely as an example, in which:

- FIG. 1 is a side view with parts cut away of a hollow auger according to the invention,
- FIG. 2 is an axial sectional view of the auger of FIG. 1,
- FIG. 3 is an end view of this same auger,
- FIGS. 4, 5 and 6 illustrate the various stages of the method of the invention, and
- FIG. 7 illustrates a possible variation of the method illustrated in FIGS. 4 to 6.

In FIGS. 1 to 3, the reference numeral 10 designates a hollow auger firstly intended to drill a hole in the ground and secondly to introduce concrete into this hole in order to produce a pile cast in the ground and which is able to withstand considerable loads.

The auger 10 is composed essentially of a blade support tube 12 of relatively large diameter, of a removable cutting head 14 mounted to slide in the support tube 12 and of a central tube 16 having a relatively small diameter and provided on the end of which is the cutting head 14.

The support tube 12 is provided with a blade 18 which is wound in the form of a uniform helix along the entire length of its outer surface, in order to form a type of Archimede's Screw. As a variation, the tube 12 could comprise two or more similar blades offset in a suitable manner one with respect to the other. The blade 18 terminates in a cutting tooth 20 at its free lower end.

The tube 12 may be made in one or more sections interconnected by keying, each section having a length of 9 meters for example.

As regards the diameters, it is necessary to distinguish the outer diameter *De* of the support tube 12 and the useful diameter *Du* of the auger or the theoretical diameter of the hole which it drills in the ground. If l designates the width of the blade 18 the following relationship can be proved:

$$Du = De + 2l$$

By way of example, the diameter D*e* will be between 300 and 800 mm for a blade with l of between 50 and 150 cm.

The following range may thus be proposed:

| | | | | | | |
|---|---|---|---|---|---|---|
| $De_{(mm)}$ | 324 | 406 | 508 | 609 | 711 | 812 |
| $l_{(mm)}$ | 60 | 70 | 80 | 100 | 120 | 150 |
| $Du_{(mm)}$ | 444 | 546 | 668 | 809 | 951 | 1112 |

It will be noted in this range that the ratio between the useful diameter of the auger or D*u* and the outer diameter D*e* of the tube 12 is approximately 1.3.

The lower part of the support tube 12 is advantageously provided with a plurality of breaking teeth 22 appropriately distributed and which each have an approximate or similar shape to that of the cutting tooth 20. In the example illustrated, the tube 12 comprises eight breaking teeth which are inclined with respect to the axis of the tube 12 by an angle equal to the inclination of the tooth 20 to this axis, the width, considered in the radial direction, of each tooth being approximately the width l of the blade 18.

The cutting head 14 is constituted by a plurality of radial blades of triangular shape 24 (four in number in the example shown) arranged uniformly around the lower end 26 of the central tube 16. These blades are fixed at their base to a part forming a sealing piston 28 which is integral with the end 26 of the tube 16. As shown, the part 28 of the cutting head 14 may be constituted by a cylindrical socket 30 having a height of 500 mm for example and two annular bases 32 and 34, whereof one (32) defines the base for fixing the radial blades 24 and the other (34) forms the base of a recovery tray 36. Provided in the cylindrical wall of the part 28, by any known means, is at least one annular groove 38 able to receive a gasket 40 preferably made from elastomeric material, such as a hollow rubber feed.

The lower edge, which is inclined with respect to the axis of the head 14, of each radial blade 24 is provided with several cutting teeth 42 (two in number in the example) appropriately distributed along this edge and advantageously offset radially from one blade to the other. These teeth 42 may be formed on the blade itself or rather connected to the edge of the latter by any known appropriate means. This latter arrangement will be preferred when it is a question of drilling a hole in very hard ground, the teeth thus being equipped with a point made from tungsten carbide or carbide steel.

In the case of ground which sticks together, each triangular blade 24 will have a spiral shape in order to expel the material which would tend to accumulate between the blades, without this particular arrangement, during rotation of the cutting head.

The central tube 16 may be constituted by one or several sections screwed one to the other. In a preferred embodiment, it is formed by a tube of the so-called "oil tube" type, having an outer diameter of 114 mm, each basic section having a length of 10 meters.

The central tube 16 is essentially intended firstly for driving the cutting head 14 both as regards rotation about its axis as well as translation along this axis and secondly, for supplying concrete (see hereafter) to the inner passageway 44 which it defines through the head 14. The lower end of the passageway 44 is closed by a removable metal sealing stopper 46 comprising a point at its lower end for penetration into the ground.

At the time of normal drilling, the tube 16 is connected by its upper end to the support tube 12 by any appropriate means (not shown) in order that the cutting head 14 is located, as shown, at the level of the teeth 20 and 22 and driven in synchronism with the latter.

In certain cases, such as drilling hard ground, it may be advantageous for the cutting head 14 to operate independently of the support tube 12 of the auger. The fact that the head is removable, also facilitates its possible replacement by another tool, such as a cutting head which is less warm or better suited to the drilling which is being undertaken, or even a core-drill.

The seal formed between the cutting head 14 and the inside of the support tube 12 by the gasket 40 makes it possible to pass through underground water without the fear of water rising through the tube 12. This same seal also makes it possible to circulate through the tube 16, a cooling and lubricating fluid which flows to the end of the cutting head 14 to rise along the blade 18 of the auger, in particular in the case of very hard ground.

The above-described auger 10 is used in combination with a relatively conventional installation, such as that illustrated in FIG. 4. An installation of this type comprises mainly a gantry 50, sliding on which is a hydraulic rotary table 52 intended to co-operate with the upper end of the support tube 12 of the auger 10 for rotating the latter and hydraulic hoists 54 and 56 of constant force, which by means of cables 58 and 60 ensure pressing/pulling forces and/or the descending/ascending translatory movements of the table 52.

By means of a rotary gasket (not shown), the upper end of the central tube 16 is associated with an elbow 62 appropriately connected to the outlet of a concrete pump (not shown).

Means for controlling the injection pressure by means of pressure pick-ups associated with pressure gauges (not shown) may be fitted to the end of the elbow 62 to check if the supply pump is maintaining an adequate pressure.

The installation is completed in a novel manner by a pulley arrangement 64 which is able to be connected to the hydraulic hoist 54 (see FIG. 5) in order to be able to exert a constant downwardly directed force of the order of one to two tons for example on the central tube 16.

It should be noted that the arrangement of the gantry 50 and table 52 has been modified with respect to similar arrangements of the prior art in order to be able to exert on the auger 10, torques which are two to three times greater than those normally exerted on conventional augers of the same diameter. By way of example, the torque applied to the auger 10 is approximately 5000 to 10000 mdaN (the usual torque on conventional augers is most frequently between 1500 and 5000 mdaN). Such an increase in the driving torque of the auger results mainly from the relatively considerable section of the cutting head and the volume of the support tube 12.

The above-described installation is used according to the following method:

In the first so-called drilling stage (see FIG. 4), the ground is attacked at the desired point by rotating the auger 10 by means of the table 52 after having made the head 14 and the tube 16 integral with the blade support tube 12. The table 52 is subjected by means of the hoists 54 and 56 to a force which may be either directed downwards or directed upwards. As the auger advances into the ground, the material is raised by the blade 18. The drilling stage is terminated when the cutting head 14 reaches the desired depth, or the level of the support layer for the pile which is being produced. It will be understood that for this stage, the drilling tool as well as the force and torque applied to the auger have been chosen depending on the ground to be drilled.

The second stage, or so-called concrete laying stage of the method of the invention is divided into two successive stages.

In the first stage, the tubes 12 and 16 are disconnected and concrete is injected under pressure into the tube 16 in order to fill the inner volume of the tube 12 until the time when the cutting head 14, pushed upwards by the pressure of the concrete, reaches a predetermined level or the level of the ground (zero level). The injection of concrete is then stopped.

In the second stage, (see FIGS. 5 and 6), a predetermined force is exerted on the cutting head 14, or rather the part forming the piston 28 which is integral therewith, by means of the pulley arrangement 64 and hoist 54 in order to exert a constant pressure (of the order of several bars) on the concrete contained in the support tube 12. The support tube 12 is then raised progressively by means of the hoist 56 and the injection of concrete under pressure in the tube 16 is checked by any known appropriate means in order to maintain the head-piston 14–28 at the desired level. An injection of this type may be controlled by a valve (not shown) controlled depending on the displacement of the upper end of the tube 16 with respect to the gantry 50.

Together with the support tube 12, the cutting head 14–28 thus forms a type of accumulator for concrete under pressure, able to eliminate a possible "shortage" of concrete if the tube 12 is raised too suddenly for example or in the case of the appearance of a "pocket" in the hole drilled by the auger. In fact, even if the injection of concrete is insufficient, the head 14 then moves downwards under the action of the force exerted on the latter by the pulley arrangement 64 in order to compensate by its movement for the volume of concrete which would have been injected at this time.

In one variation of the above method, illustrated in FIG. 7, the cutting head 14 is extracted from the support tube 12 at the end of the drilling stage and a flexible sheath 66 which is possible extensible and closed at its lower end is introduced into the tube 12. The head-piston 14–28 is then re-introduced into the tube 12 thus equipped with the sheath 66. As the tube 12 rises during the second stage described above, the sheath is extracted progressively from the tube 12 under the action of the concrete which is injected therein.

The introduction of the sheath 66 into the tube may be carried out not directly as above-mentioned, but by means a cylindrical container having a single or double wall 68. In this case, the sheath 66 is advantageously folded up around the inner cylindrical wall 70 of the container 68. It will be understood that the container 68 is raised with the support tube 12, the sheath being extracted from the container as above, by the concrete injected through the tube 16.

Naturally, the invention is not limited to the embodiments described above and numerous modifications may be applied thereto without diverting from the framework of the present invention. In particular, the shape of the auger and in particular of the detachable arrangement constituted by the cutting head 14 and the part forming the piston 28, the construction of the means (pulley means 62), exerting a constant force on this arrangement 14–28 the nature of the concrete injector.

What is claimed is:

1. Method for producing piles cast in the ground, according to which a hole is drilled in the ground by means of a hollow auger and the auger is then raised progressively from the drill-hole whilst simultaneously injecting concrete under pressure into the hole thus obtained, characterized in that an auger is used provided with a blade support tube and a removable cutting head which is able to slide in a sealed manner in the blade support tube of the auger, and in that the injection of concrete takes place through a central passageway provided in the cutting head, which is undertaken in two successive stages, comprising a first stage in which concrete is injected into the support tube by progressively raising the cutting head to a predetermined level, namely zero level in the latter, and a second stage in which the auger is raised from the drill-hole by exerting a constant pressure on the cutting head and whilst injecting concrete in order to maintain this head at the predetermined level.

2. Method according to claim 1, characterized in that prior to the injection of the concrete, the cutting head is extracted from the support tube for introducing a flexible, cylindrical sheath which is closed at its lower end and in that the cutting head is re-introduced into the support tube thus equipped.

3. Method according to claim 2, characterised in that the flexible sheath is introduced into the support tube by means of a cylindrical container wall.

* * * * *